United States Patent [19]

Trotter

[11] Patent Number: 4,616,835

[45] Date of Patent: Oct. 14, 1986

[54] ARROW TIP

[76] Inventor: George H. Trotter, 7107 Janey St., Shreveport, La. 71108

[21] Appl. No.: 726,633

[22] Filed: Apr. 24, 1985

[51] Int. Cl.[4] ..... F41B 5/02

[52] U.S. Cl. ..... 273/421

[58] Field of Search ..... 273/421, 422, 420, 416

[56] References Cited

U.S. PATENT DOCUMENTS

| | | | |
|---|---|---|---|
| D. 236,465 | 8/1975 | Hamilton | 273/421 X |
| 2,137,014 | 11/1938 | Brochu | 273/422 X |
| 2,289,284 | 7/1942 | Chandler | 273/422 |
| 2,676,017 | 4/1954 | Selent et al. | 273/421 |
| 3,741,542 | 6/1973 | Karbo | 273/422 |
| 3,854,723 | 12/1974 | Wilson | 273/420 |

*Primary Examiner*—Paul E. Shapiro

*Attorney, Agent, or Firm*—John M. Harrison

[57] ABSTRACT

An arrow tip for hunting arrows which includes a slotted head or blade mount fitted with a v-shaped deep slot and a v-shaped shallow slot oriented in transverse relationship in the blade mount. A first shaped base blade having a truncated tip and downwardly extending base blade legs is seated in the deep slot and a second shaped top blade, having a sharpened tip and provided with downwardly extending top blade legs, is seated in the shallow slot with the fork of the top blade legs touching the truncated tip of the base blade and the tip of the top blade projecting above the end of the blade mount. In a preferred embodiment, the extending ends of the base and top blade legs are fitted with stabilizing members projecting toward the blade mount shank and designed to bias against an arrow shaft carrying the arrow tip to impart a curvature into the top blade legs and base blade legs.

6 Claims, 11 Drawing Figures

ARROW TIP

BACKGROUND OF THE INVENTION

1. Field of the Invention

This invention relates to archery and more particularly, to hunting arrows and an arrow tip for hunting arrows. The arrow tip of this invention is designed to effect more impact and cutting efficiency per pound of bow pull than conventional arrow "broadheads" or tips and also achieves the objective of causing greater internal hemorrhaging and organ in game for quicker, cleaner kills. The arrow tip is characterized by twin blades which present four sharp blade edges extending downwardly at essentially 90 degrees with respect to each other from a slotted head or blade mount. The slotted blade mount can be provided with a threaded shank for cooperation with the internal threads of an aluminum arrow, or it may be shaped for fastening to a wood or fiberglass arrow. The symmetrically oriented blades each include a pair of downwardly extending, thin, sharp legs which bend inwardly upon impact with the bone and heavy muscle of a game animal to aid penetration, and subsequently expand upon penetration of the tip into the body cavity to maximize internal damage.

In a preferred embodiment of the invention the legs are sharpened on opposite faces and the extending ends of the legs are fitted with stabilizing members which project toward the blade mount shank and bias the legs in an arc to further stabilize the arrow in flight.

2. Description of the Prior Art

Archery has long been a popular sport in the United States and across the world and in recent years, a great interest in hunting with bow and arrow has evolved. With the rapidly expanding interest in bow hunting has come an explosion in bow and arrow technology and particularly in bow design and arrow tip development. Because tissue damage is critical in stopping certain large game animals such as deer and elk with an arrow, a great amount research effort has been directed toward the design of bows, arrows and arrow tips for achieving this end. For example, compound bows having a system of cables and cooperating cams have been developed for the purpose of delivering an arrow to the target area with greater accuracy and impact than is possible with conventional recurve bows of comparable draw tension. Furthermore, the "broadhead" hunting arrow tip was specially developed in several variations with outwardly projecting blades and a configuration designed to help achieve a quick, clean game kill. However, on may occasions, conventional broadheads have only wounded the game, and therefore failed to achieve the intended objective. A good flying, lightweight, well sharpened broadhead arrow tip is necessary for taking deer, elk and other large game animals and conventional broadheads frequently fail to meet these requirements. The modern bullet-tipped broadheads generally require about $\frac{1}{8}$ to $\frac{3}{8}$ of an inch of penetration before the blades begin to cut effectively and many of these arrow tips are heavy and are not symmetrical in shape, two factors which frequently cause the supporting arrow to describe an erratic flight path.

Accordingly, it is an object of this invention to provide an arrow tip which is characterized by a pair of blades mounted in transverse relationship and having downwardly and outwardly extending legs which initially compress toward the arrow shaft upon impact with the heavy muscle or bone of a game animal and subsequently spring back into extended configuration after impact and penetration to achieve maximum tissue and organ damage for a quick, clean kill.

Another object of the invention is to provide a new and improved, lightweight hunting arrow tip which includes a pair of tapered, transversely oriented blades mounted at different levels in a slotted blade mount for cooperation with an arrow and having a wider area of penetration and greater cutting efficiency than conventional hunting broadhead tips for increased effectiveness in killing game.

Yet another object of the invention is to provide a new and improved, lightweight tip for hunting arrows which is characterized by a pair of thin, "free standing", transversely-mounted blades having thin, tapered, symmetrically disposed, downwardly-extending and symmetrically sharpened legs for equalizing wind resistance when the arrow is in flight and facilitating greater arrow accuracy.

A still further object of this invention is to provide a new and improved arrow tip for hunting arrows which is characterized by a pair of flat, thin blades mounted in two v-shaped slots at different levels in a slotted blade mount, the blades featuring four sharpened cutting edges disposed in essentially 90 degree, adjacent relationship and having downwardly and outwardly extending, "free standing" sharpened legs, the extending ends or tips of which terminate in a common plane and are capable of compressing upon contact with the bone or heavy muscle of a game animal and expanding after entry of the arrow tip into the animal body.

Another object of the invention is to provide a hunting arrow tip which includes a pair of thin, sharp blades, each having a pair of downwardly and outwardly extending, tapered legs, which blades are removably locked in v-shaped notches at different levels in a slotted head, with the blades in close transverse proximity to each other for strength and the blade legs symmetrically projecting from the head.

Still another object of the invention is to provide a hunting arrow tip which includes a pair of thin, sharp blades transversely seated at different levels in a slotted head, with downwardly and outwardly extending, tapered legs and stabilizing members extending from the ends of the legs toward the shank of the slotted head for biased engagement with an arrow shaft carrying the arrow tip and effecting a curvature in the tapered legs.

SUMMARY OF THE INVENTION

These and other objects of the invention are provided in a lightweight arrow tip characterized by a pair of flat blades which are transversely and symmetrically mounted in v-shaped notches in stacked relationship in a slotted blade mount and having sharpened, downwardly and outwardly extending, free standing, tapered blade members or legs disposed in essentially 90 degree, adjacent relationship, for maximum flying accuracy and cutting and penetration efficiency in killing game. In a preferred embodiment, the base blade is turncated at the top and the top blade projects above the base blade and tapers to a sharpened edge. In another preferred embodiment, stabilizing members extend from the extending ends of the legs toward the shank of the slotted head for biased engagement with an arrow shaft carrying the arrow tip and providing an arc or curvature in the tapered legs.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8, 9, 10, 11:
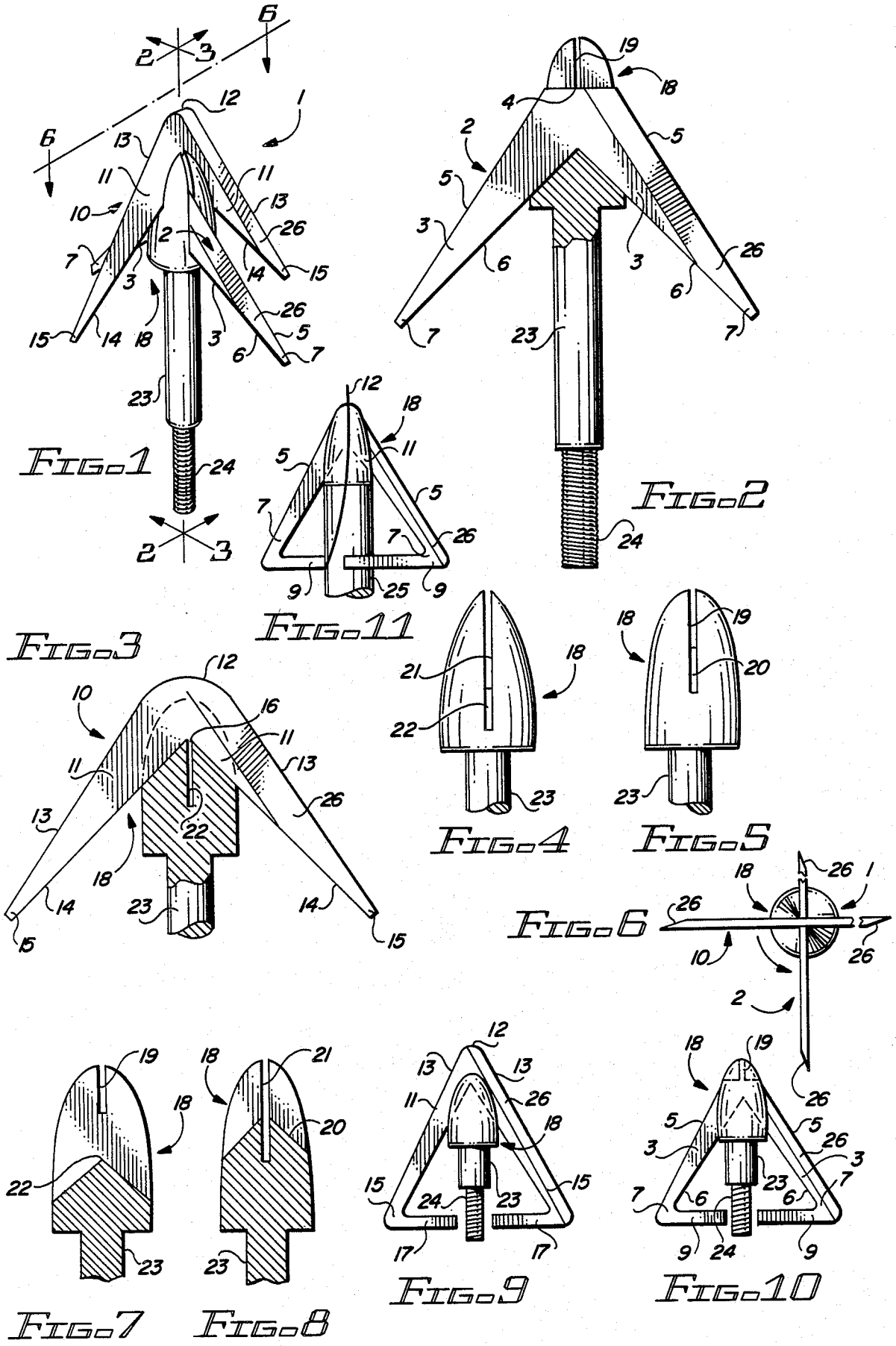
FIG. 1 is a perspective view of a preferred embodiment of the arrow tip of this invention.
FIG. 2 is a sectional view, taken along line 2—2 of the arrow tip illustrated in FIG. 1.
FIG. 3 is a sectional view, taken along line 3—3 of the arrow tip illustrated in FIG. 1.
FIG. 4 is a side elevation of a blade mount and a deep tapered slot illustrated in position for insertion and mounting of a base blade.
FIG. 5 is a front elevation of the blade mount and a shallow tapered slot in position for insertion and mounting of a top blade.
FIG. 6 is a top view, partially in section, of the arrow tip illustrated in FIG. 1.
FIG. 7 is a sectional view of the blade mount illustrated in FIG. 5.
FIG. 8 is a sectional view of the blade mount illustrated in FIG. 4.
FIG. 9 is a side elevation of an alternative embodiment of the top blade element ilustrated in FIG. 3.
FIG. 10 is a front elevation of an alternative embodiment of the base blade element illustrated in FIG. 2.
FIG. 11 is an elevation of the combined embodiments of the top blade element and base blade element illustrated in FIGS. 9 and 10; with the arrow tip mounted on an arrow shaft.

Referring intially to FIGS. 1-8 of the drawings, in a preferred embodiment the arrow tip of this invention is generally illustrated by reference numeral 1. The arrow tip 1 includes a base blade 2 and a top blade 10, seated in transverse relationship with respect to each other in a blade mount 18. As illustrated in FIGS. 1, 2, 4 and 7 of the drawing, the base blade 2 is characterized by a pair of base blade legs 3, extending downwardly and outwardly from a truncated base blade top 4. The base blade legs 3 define a base blade fork 8 at the juncture of the base blade trailing edges 6, as illustrated in FIG. 2 and the base blade leading edges 5 are sharpened along opposite faces 26, as illustrated in FIGS. 1, 2 and 6. The base blade legs 3 taper to define base blade leg tips 7 and are sufficiently resilient to bend when striking and penetrating a game animal. The blade mount 18 is further characterized by a blade mount shank 23, fitted with shank threads 24, for threadibly securing the arrow tip 1 to an arrow shaft 25, illustrated in FIG. 11. Alternatively, the blade mount shank 23 can be configured as desired for attachment by any desired means to the arrow shaft 25.

Referring now to FIGS. 1, 3, 5 and 8, the top blade 10 is characterized by a pair of downwardly and outwardly extending top blade legs 11, which join to define a top blade tip 12 and extending downwardly to top blade leg tips 15. The top blade legs 11 are each characterized by top blade leading edges 13 and top blade trailing edges 14. The top blade leading edges 13 are sharpened on opposite surfaces to define faces 26, as illustrated in FIGS. 1, 3 and 6 and the top blade trailing edges 14 join each other at the top blade fork 16.

As further illustrated in FIGS. 1-8 of the drawing, the base blade 2 is seated in a deep tapered slot 21, provided in the blade mount 18, with the base blade trailing edges 6 and the base blade fork 8 conforming in angular relationship to, and resting against the deep slot saddle 22, in order to stabilize the base blade 2 in the blade mount 18. Similarly, the top blade 10 is seated and mounted in a shallow tapered slot 19, provided in the blade mount 18, in transverse relationship with the respect to the base blade 2. The top blade trailing edges 14 and the top blade fork 16 conform to and are secured against the shallow slot saddle 20 and the top blade fork 16 touches the base blade top 4 in transverse relationship when the top blade 10 and base blade 2 are secured in the blade mount 18, as illustrated. When the top blade 10 and the base blade 2 are so oriented in stacked relationship in the blade mount 18, the top blade tip 12 projects above the tapered end of the blade mount 18, in order to present a sharp surface for initial penetration when the arrow tip 1 strikes an animal. Furthermore, in a most preferred embodiment of the invention, the top blade legs 11 are slightly longer than the base blade legs 3, in order to compensate for the higher seating of the top blade 10 in the blade mount 18 and insure that the top blade leg tips 15 terminate in the same plane as the base blade legs tips 7. Furthermore, the base blade leg tips 7 and the top blade tips 15 are substantially equidistant from each other.

Referring now to FIGS. 1-3, 9, 10 and 11 of the drawing, in another preferred embodiment of the invention the base blade legs 3 of the base blade 2 are provided with inwardly extending base blade stabilizers 9, which project from the extending ends or base blade leg tips 7, of the base blade legs 3 and terminate just short of the shank threads 24 in the blade mount shank 23. In like manner, the top blade legs 11 are fitted with inwardly extending top blade stabilizers 17 which project from the extending ends or top blade leg tips 15, of the top blade legs 11 toward the shank threads 24. As illustrated in FIG. 11, the projecting ends of the base blade stabilizers 9 and top blade stabilizers 17 are biased against the arrow shaft 25 by tension in the base blade legs 3 and top blade legs 11 and serve to bend the base blade legs 3 and the top blade legs 11 into a helix or curve. Since the base blade legs 3 and the top blade legs 11 are sharpened on opposite faces 26, which correspond to the concave side of the helix or curve, air pressure exerted against the faces 26 of the base blade legs 3 and top blade legs 11 effects rotation of the arrow tip 1 in the direction of convex curvature. Accordingly, referring again to FIG. 11 of the drawing, the direction of rotation of the arrow tip 1 is in the right hand, or clockwise direction when viewed from the bottom.

In operation, and referring again to the drawing, it will be appreciated that the base blade 2 and top blade 10 are securely seated by means of glue, epoxy, welding, brazing, or other techniques known to those skilled in the art, in transverse relationship in the blade mount 18, as illustrated in FIG. 1. Under circumstances where the base blade 2 and the top blade 10 are fitted with base blade stabilizers 9 and top blade stabilizers 17 as illustrated in FIGS. 9, 10 and 11, the length of the base blade stabilizers 9 and the top blade stabilizers 17 are chosen such that the extending ends thereof are sufficiently long to bias against the arrow shaft 25 and effect a desired degree of curvature and deflection in the base blade legs 3 and the top blade legs 11, as heretofore described. The base blade leading edges 5 and the top blade leading edges 13 are carefully sharpened, along with the top blade tip 12, to effect rapid and efficient penetration when striking an animal.

Referring now to FIGS. 1 and 6 of the drawing, it will be further appreciated by those skilled in the art that the symmetrical orientation of the base blade 2 with respect to the top blade 10 presents a uniform resistance to the air through which the arrow tip 1 must travel. Since the base blade leading edges 5 and the top blade leading edges 13 are beveled on opposite surfaces or faces 26, the wind resistance against the base blade 2 and the top blade 10 in such that the arrow is constrained to rotate, thereby further stabilizing the arrow and increasing the efficiency of the arrow tip 1, both in trajectory and penetration. As viewed in FIG. 6, the arrow tip 1 will rotate in the counterclockwise direction as indicated by the curved arrow when mounted on an arrow shaft 25 and shot from a bow (not illustrated). Since the base blade legs 3 and the top blade legs 11 are very thin, both as to cross-section and width, very little air resistance is presented by the arrow tip 1 and the arrow trajectory is exceptionally true. Furthermore, this base blade 12 and top blade 10 structure facilitates inward bending of the base blade legs 3 and the top blade legs 11 upon striking an animal, with subsequent outward springing of the base blade legs 3 and the top blade legs 11 for maximum tissue damage and retention of the arrow tip 1 in the body of the animal, thus increasing the likelihood of a clean kill. This "springing" effect of the base blades 3 and top blades 11 is also apparent in the embodiment which includes the base blade stabilizers 9 and top blade stabilizers 17, since the extending ends of the base blade stabilizers 9 and top blade stabilizers 11 are not secured to the arrow shaft 25. As heretofore described, use of the base blade stabilizers 9 and top blade stabilizers 17 is made to further control the stability of the arrow in flight by curving deflection of the base blade legs 3 and the top blade legs 11.

In yet another preferred embodiment of the invention, the angle of projection of the base blade legs 3 and the top blade legs 11 at the base blade fork 8 and the top blade fork 16, respectively, is from about 55 to about 65 degrees and in a most preferred embodiment, it has been found that this angle should be about 60 degrees to achieve optimum cutting and penetration efficiency. Furthermore, in another most preferred embodiment of the invention, the base blade 2 and the top blade 10, as well as the blade mount 18 are constructed of stainless steel, in order to provide resistance to corrosion and high integrity of the sharpened base blade leading edges 5 and top blade leading edges 13.

While the preferred embodiments of the invention have been described above, it will be recognized and understood that various modifications may be made therein and the appened claims are intended to cover all such modifications which may fall within the spirit and scope of the invention.

Having described my invention with the particularity set forth above, what is claimed is:

1. An arrow tip for removable mounting on an arrow shaft, said arrow tip comprising:

(a) a generally bullet-shaped blade mount and a threaded shank extending from one end of said blade mount from threadibly connecting said blade mount to the arrow shaft;

(b) a first V-shaped slot provided longitudinally in said blade mount;

(c) a base blade having a truncated tip and a pair of base blade legs inserted in said first V-shaped slot, said base legs extending from said first V-shaped slot in a selected angular relationship;

(d) a second V-shaped slot provided longitudinally in said blade mount, said second V-shaped slot located above said first V-shaped slot and substantially transversely oriented with respect to said first V-shaped slot; and (e) a top blade having a sharpened tip and a pair of top blade legs inserted in said second V-shaped slot, said top blade legs extending from said second V-shaped slot in said selected angular relationship.

2. The arrow tip of claim 1 further comprising a first stabilizer extending from one of said base blade legs to the arrow shaft; a second stabilizer extending from the other one of said base blade legs to the arrow shaft; a third stabilizer extending from one of said top blade legs to the arrow shaft; and a fourth stabilizer extending from the other one of said top blade legs to the arrow shaft, with the extending ends of said first stabilizer, said second stabilizer, said third stabilizer and said fourth stabilizer biased against the arrow shaft, whereby said base blade legs and said top blade legs are each caused to describe an arc.

3. The arrow top of claim 1 further comprising sharpened base blade faces provided on opposite sides of said base blade and said base blade legs and sharpened top blade faces provided on opposite sides of said top blade and said top blade legs.

4. The arrow tip of claim 1 further comprising:

(a) a first stabilizer extending from one of said base blade legs to the arrow shaft; a second stabilizer extending from the other one of said base blade legs to the arrow shaft; a third stabilizer extending from one of said top blade legs to the arrow shaft; and a fourth stabilizer extending from the other one of said top blade legs to the arrow shaft, with the extending ends of said first stabilizer, said second stabilizer, said third stabilizer and said fourth stabilizer biased against the arrow shaft, whereby said base blade legs and said top blade legs are each caused to describe an arc having a concave side; and (b) sharpened base blade faces provided on the concave side of said base blade and said base blade legs and sharpened top blade faces provided on the concave side of said top blade and said top blade legs.

5. The arrow tip of claim 1 wherein said base blade legs and said top blade legs terminate in substantially the same plane.

6. The arrow tip of claim 1 wherein said base blade legs and said top blade legs terminate in substantially the same plane and further comprising:

(a) a first stabilizer extending from one of said base blade legs to the arrow shaft; a second stabilizer extending from the other one of said base blade legs to the arrow shaft; a third stabilizer extending from one of said top blade legs to the arrow shaft; and a fourth stabilizer extending from the other one of said top blade legs to the arrow shaft, with the extending ends of said first stabilizer, said second stabilizer, said third stabilizer and said fourth stabilizer biased against the arrow shaft, whereby said base blade legs and said top blade legs are each caused to describe an arc having a concave side; and (b) sharpened base blade faces provided on the concave side of said base blade and said base blade legs and sharpened top blade faces provided on the concave side of said top blade and said top blade legs.

* * * * *